US008006413B2

(12) United States Patent
Washburn

(10) Patent No.: US 8,006,413 B2
(45) Date of Patent: Aug. 30, 2011

(54) STOP MEMBER FOR SNOWPLOW ASSEMBLY

(75) Inventor: Shawn Washburn, Cleveland, OH (US)

(73) Assignee: Meyer Products LLC, Cleveland, OH (US)

( * ) Notice: Subject to any disclaimer, the term of this patent is extended or adjusted under 35 U.S.C. 154(b) by 114 days.

(21) Appl. No.: 12/396,646

(22) Filed: Mar. 3, 2009

(65) Prior Publication Data

US 2010/0223819 A1 Sep. 9, 2010

(51) Int. Cl.
*E01H 5/04* (2006.01)

(52) U.S. Cl. ..... 37/232; 172/811

(58) Field of Classification Search ..... 37/231, 37/232, 234; 172/810, 811, 818, 820
See application file for complete search history.

(56) References Cited

U.S. PATENT DOCUMENTS

| | | | | |
|---|---|---|---|---|
| 4,074,448 | A | 2/1978 | Niemela | |
| 4,597,205 | A | 7/1986 | Guest | |
| 4,727,665 | A | 3/1988 | Verseef | |
| 5,129,170 | A * | 7/1992 | Fusilli | 37/231 |
| 5,706,591 | A | 1/1998 | Wissmiller | |
| 5,870,839 | A | 2/1999 | Wissmiller | |
| 6,276,075 | B1 | 8/2001 | Kost et al. | |
| 6,381,880 | B1 * | 5/2002 | Curtis | 37/231 |
| 6,408,546 | B2 * | 6/2002 | Curtis | 37/231 |
| 6,618,964 | B2 | 9/2003 | Kost et al. | |
| 6,618,965 | B1 | 9/2003 | Schultz et al. | |
| 6,701,646 | B2 | 3/2004 | Schultz et al. | |
| 6,775,933 | B2 | 8/2004 | Koch et al. | |
| 6,860,039 | B2 | 3/2005 | Schultz et al. | |
| 6,874,582 | B2 | 4/2005 | Hollinrake et al. | |
| 6,941,685 | B2 | 9/2005 | Goy et al. | |
| 7,114,270 | B2 | 10/2006 | Potak | |
| 7,134,227 | B2 | 11/2006 | Quenzi et al. | |
| 7,146,754 | B2 | 12/2006 | Schultz et al. | |
| 7,290,359 | B2 | 11/2007 | Potak | |

FOREIGN PATENT DOCUMENTS

| | | |
|---|---|---|
| JP | 09-328730 | 12/1997 |
| KR | 10-0159063 | 1/1999 |
| KR | 20-0414508 | 4/2006 |

OTHER PUBLICATIONS

PCT—Notification of Transmittal International Preliminary Report on Patentability, Jan. 6, 2011.
PCT—International Preliminary Report on Patentability, Jan. 6, 2011.
International Search Report, dated Nov. 12, 2010, PCT/US2010/025887.
Written Opinion of the International Searching Authority, dated Nov. 12, 2010, PCT/US2010/025887.

* cited by examiner

*Primary Examiner* — Thomas Will
*Assistant Examiner* — Jamie L McGowan
(74) *Attorney, Agent, or Firm* — Emerson Thomson Bennett; Roger D. Emerson; Timothy D. Bennett

(57) ABSTRACT

A snowplow assembly may include a support member, a mount member, and an actuator. The mount member may be operatively connected to a plow blade and pivotally connected to the support member and the mount member may pivot about a substantially vertical axis with respect to the support member. The mount member may include a first stop member for limiting the pivotal motion of the mount member about the substantially vertical axis in a first direction. The actuator may pivot the mount frame about the substantially vertical axis and a first end of the actuator may be operatively connected to the snowplow assembly and a second end may be pivotally connected to the mount member.

19 Claims, 9 Drawing Sheets

STOP MEMBER FOR SNOWPLOW ASSEMBLY

I. BACKGROUND OF THE INVENTION

A. Field of Invention

This invention pertains to the art of methods and apparatuses related to snowplows and more specifically to methods and apparatus related to limiting the pivoting motion of the snowplow.

B. Description of the Related Art

It is well known in the art to provide a snowplow on the front of a vehicle for displacing snow, sleet, ice and the like along a roadway, driveway or other ground surface. Generally, a snowplow assembly will include a plow blade that is used to contact the snow and a mount assembly that is used to mount the snowplow mechanism to the vehicle. Many snowplow assemblies pivotally attach the plow blade to the mount assembly allowing the blade to pivot about a vertical pivot axis and direct plowed snow to either side of the vehicle path. The mount assemblies are often pivotally attached to a vehicle for selectively raising and lowering the snowplow assembly using hydraulic controls located in the vehicle. The plow blade may also be pivotally attached to the mount assembly allowing the plow blade (or a portion of the blade) to pivot about a horizontal mounting axis. Springs may connect between the plow blade and the mount assembly for biasing the plow blade in an upright position and for dampening the rotational movement about the horizontal mounting axis when the plow blade encounters an obstacle.

It is also known in the art to provide one or more actuators with snowplow assemblies for use in pivoting the plow blade about the vertical pivot axis. Such actuators are commonly hydraulic cylinders. Some of these known snowplow assemblies also include one or more stops for limiting the pivotal motion of the plow blade around the vertical pivot axis. These pivotal stops can protect the actuator from over-extension, can protect the actuator from loads imparted on the plow blade from obstacles, or can provide additional support for the plow blade when the plow blade is in a fully pivoted position.

While known pivotal stops generally work well for their intended purpose, they have disadvantages. One disadvantage is that known pivotal stops do not adequately distribute the loads that they incur to the mount assembly. Another problem is that known pivotal stops are known to contribute to alignment problems for the actuators and the mount assembly/snowplow frame interface. Therefore, what is needed is a mount assembly with a robust pivotal stop that can distribute large loads and maintain alignment during typical snowplow use conditions.

II. SUMMARY OF THE INVENTION

According to one embodiment of the present invention, a snowplow assembly may include a support member, a mount member, and an actuator. The support member may include a first member having a first end and a second end, wherein the second end is operatively attached to a vehicle; a second member having a first end and a second end, wherein the second end is operatively attached to a vehicle, and wherein the first end of the first member is fixedly attached to the first end of the second member forming an apex portion, and a cross member having: (1) a first end fixedly attached to the first member at a position spaced from the first end of the first member, wherein at least a portion of the cross member is between a first horizontal plane defined by a top portion of the first member and a second horizontal plane defined by a bottom portion of the first member, (2) a second end fixedly attached to the second member at a position spaced from the first end of the second member, wherein at least a portion of the cross member is between a third horizontal plane defined by a top portion of the second member and a fourth horizontal plane defined by a bottom portion of the second member, (3) a forward side extending from the first end to the second end of the cross member, and (4) a rearward side extending from the first end to the second end of the cross member, wherein the forward side is closer to the apex portion than the rearward side, and wherein the forward side defines a first vertical plane and the rearward side defines a second vertical plane. The mount member may include a plow blade side operatively connected to a plow blade, a support side pivotally connected to the apex portion, wherein the mount member pivots about a substantially vertical axis with respect to the support member a first stop member for limiting the pivotal motion of the mount member about the substantially vertical axis in a first direction, wherein at least a portion of the first stop member operatively contacts at least a portion of the support member between the first vertical plane and the second vertical plane, a second stop member for limiting the pivotal motion of the mount member about the substantially vertical axis in a second direction, wherein at least a portion of the second stop member operatively contacts at least a portion of the support member between the first vertical plane and the second vertical plane. The actuator may pivot the mount frame about the substantially vertical axis, wherein a first end is operatively connected to the snowplow assembly and a second end is pivotally connected to the mount member.

According to another embodiment of the invention, a snowplow assembly may include a support member having a first end operatively attached to a vehicle, a mount member, and an actuator. The mount member may include a plow blade side operatively connected to a plow blade, a support side pivotally connected to the support member, wherein the mount member pivots about a substantially vertical axis with respect to the support member, a first stop member for limiting the pivotal motion of the plow blade about the substantially vertical axis in a first direction having: (1) a first stop plate having a height and a width with a first ratio of height to width between 0.5 and 5, and (2) a C-shaped portion for positioning the first stop member to contact the first side of the support member, wherein the first stop plate operatively contacts a first side of the support member defining a first contact surface, and wherein the first contact surface extends substantially the entire length from a top portion to a bottom portion of the first side of the support member, a second stop member for limiting the pivotal motion of the plow blade about the substantially vertical axis in a second direction having: (1) a second stop plate having a height and a width with a first ratio of height to width between 0.5 and 5, and (2) a C-shaped portion for positioning the first stop member to contact the second side of the support member, wherein the second stop plate operatively contacts a second side of the support member defining a second contact surface, and wherein the second contact surface extends substantially the entire length from a top portion to a bottom portion of the second side of the support member. The actuator may pivot the plow blade about the substantially vertical axis, wherein a first end is pivotally connected to the support member and a second end is pivotally connected to the mount member, and wherein a second ratio of a first distance between the second end of the actuator and the substantially vertical axis and a second distance between the stop member and the substantially vertical axis is between 1.1 and 2.0.

One advantage of this invention is that the large, robust pivot stops are integrated with the plow mount member.

Another advantage of this invention is that the pivot stops contact the A-frame at a position where an internal cross-member provides additional support.

Still other benefits and advantages of the invention will become apparent to those skilled in the art to which it pertains upon a reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION OF THE INVENTION

Figure 1:
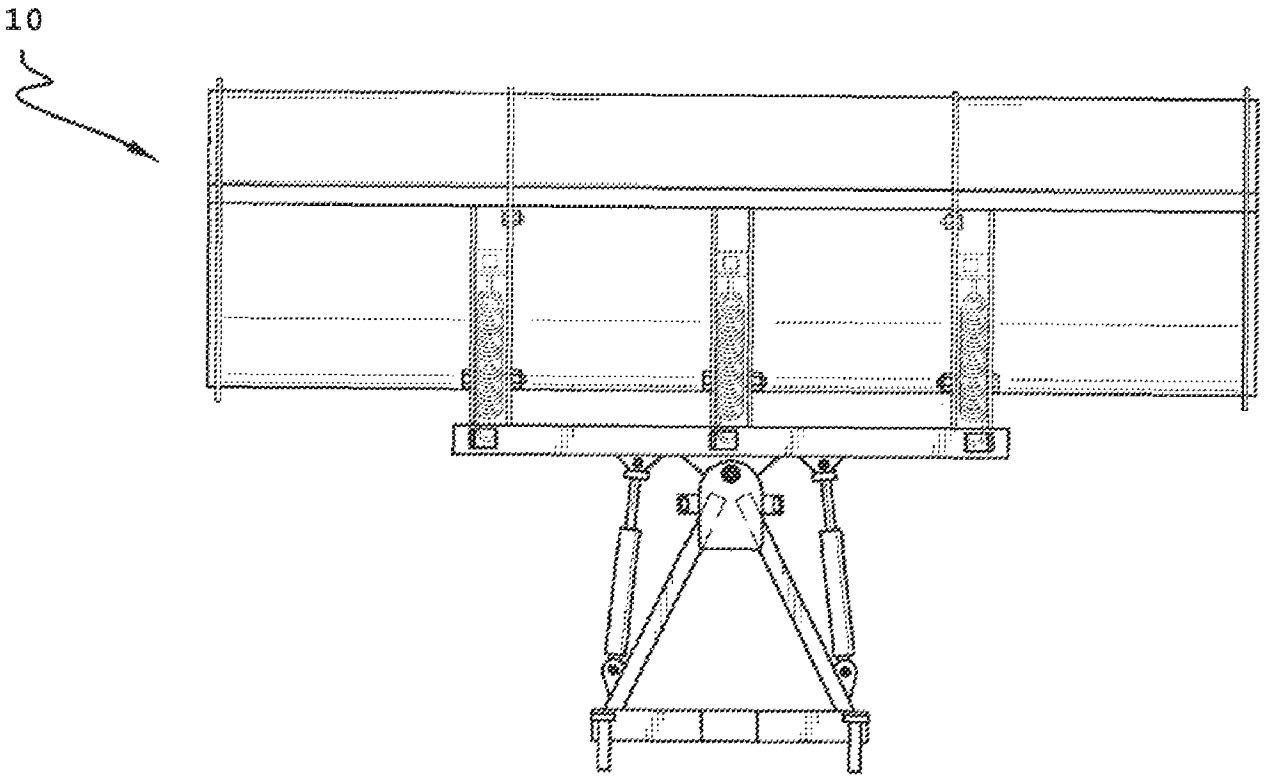
FIG. 1 PRIOR ART
FIG. 1 is a top perspective view of a snowplow assembly of the prior art.
Figure 2:
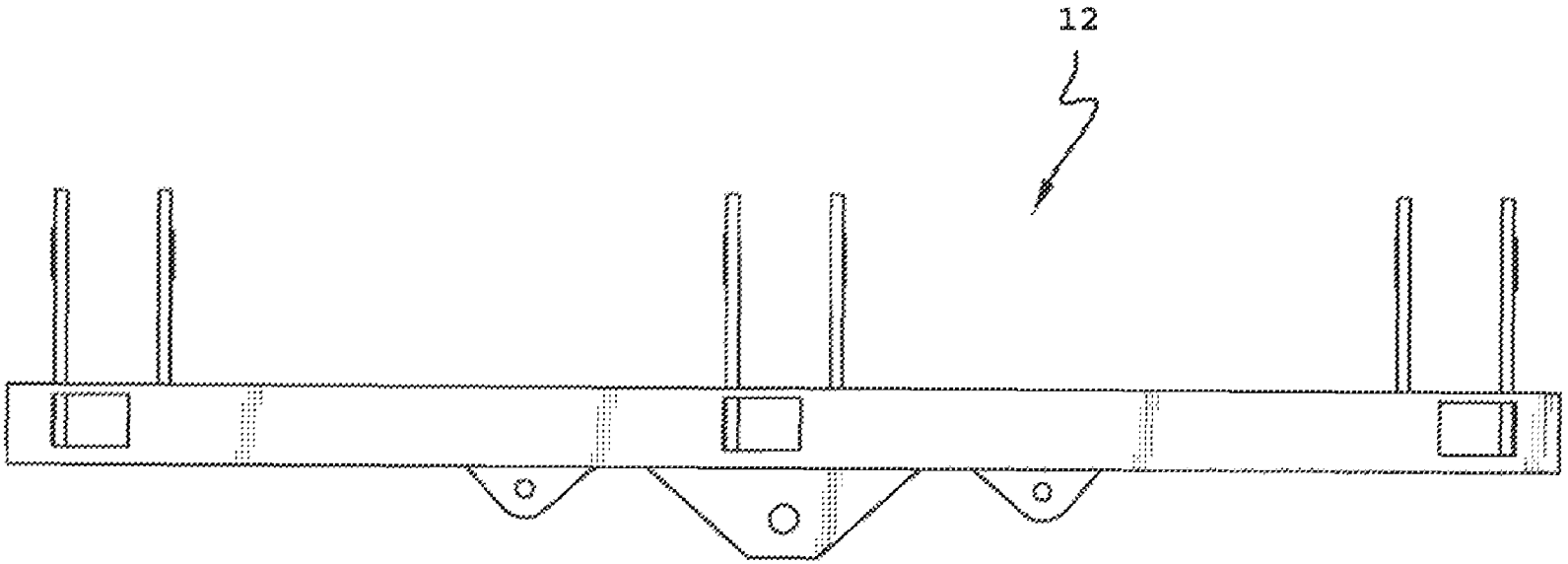
FIG. 2 PRIOR ART
FIG. 2 is a top perspective view of a mount frame of the prior art.

Referring now to the drawings wherein the showings are for purposes of illustrating embodiments of the invention only and not for purposes of limiting the same, and wherein like reference numerals are understood to refer to like components, FIG. 1 shows a snowplow assembly 10 of the prior art. FIG. 2 shows a mount assembly 12 of the prior art.

Figure 3:
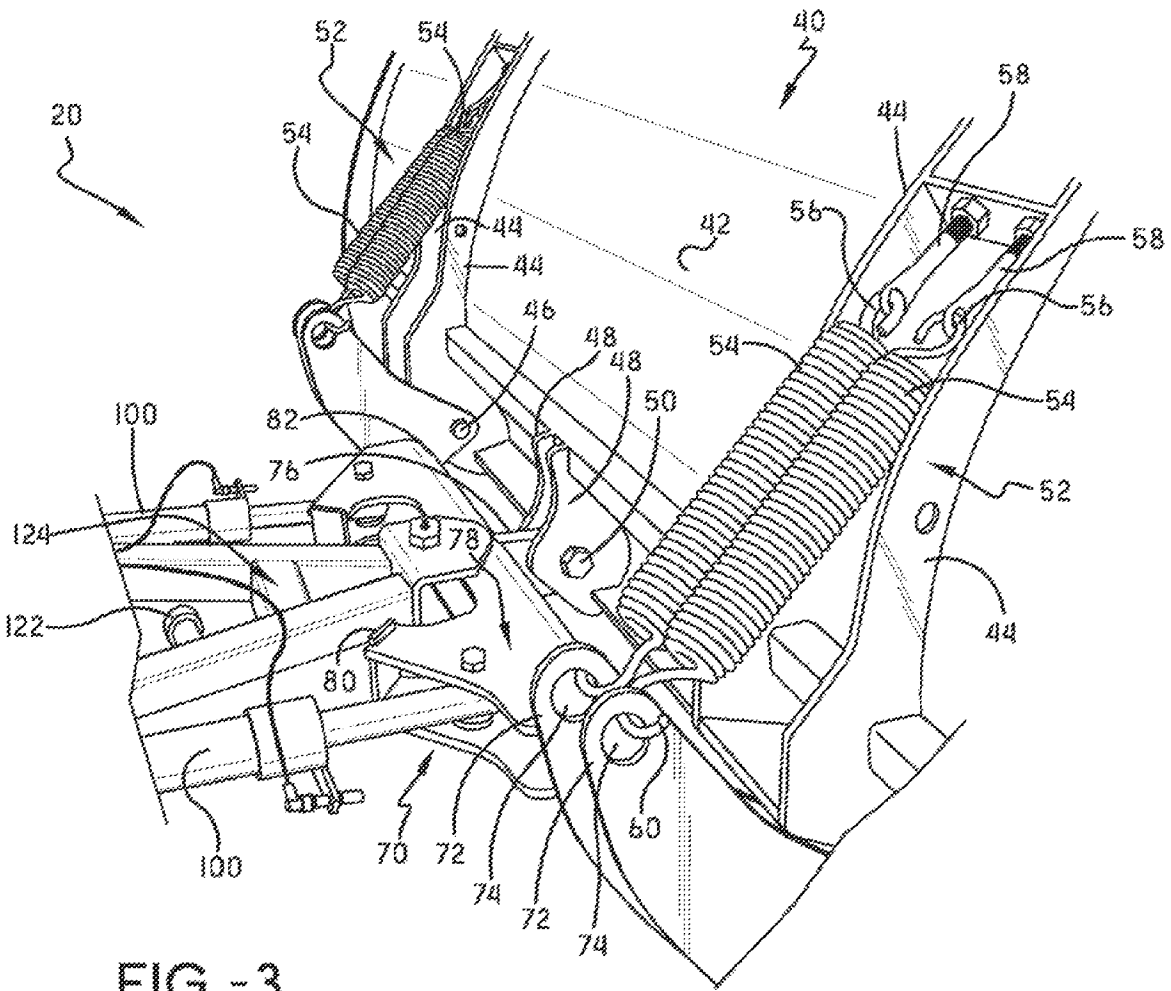
FIG. 3 is a side perspective view of a snowplow assembly.

With reference now to FIG. 3, the snowplow assembly 20 according to one embodiment of this invention may include a plow blade assembly 40, a mount assembly 70, and a support assembly 110. The plow blade assembly 40 may include a curved plow blade or moldboard 42 having a snow engaging surface for use in plowing snow and other frozen or partially frozen precipitation. The plow blade assembly 40 may also include at least one mounting flange 44 for operatively connecting the plow blade assembly 40 to a mount assembly 70, as is well known in the art. In one embodiment, the plow blade assembly has four mounting flanges 44. Each mounting flange 44 may have an opening sized to receive a bolt or pin 46 for pivotally connecting the plow blade assembly 40 to the mount assembly 70. Each mounting flange 44 may extend substantially the entire height of the plow blade 42. The plow blade 42 may pivot about a substantially horizontal axis defined by the bolt or pin 46.

With continuing reference to FIG. 3, the plow blade assembly 40 may have at least one support flange 48 for operatively connecting the plow blade assembly 40 to a mount assembly 70. The support flange 48 may be located near a midpoint along the length of the plow blade 42. In one embodiment, the plow blade assembly 40 has two support flanges 48. Each support flange 48 may have an opening sized to receive a bolt or pin 50 for pivotally connecting the plow blade assembly 40 to the mount assembly 70. The plow blade 42 may pivot about a substantially horizontal axis defined by the bolt or pin 50. The plow blade assembly 40 may include at least one trip mechanism 52 for biasing the plow blade 42 in an upright position and for dampening the rotational movement about the horizontal axis when the plow blade encounters an obstacle. Each trip mechanism 52 may include at least one spring 54 operatively attached to the plow blade 42 and operatively attached to the mount assembly 70. One end 56 of the spring 54 attaches to a bolt 58 fastened to the plow blade 42. The second end 60 of the spring 54 attaches to an opening 74 in a flange 72 fixedly attached to the mount assembly 70.

Figure 4:
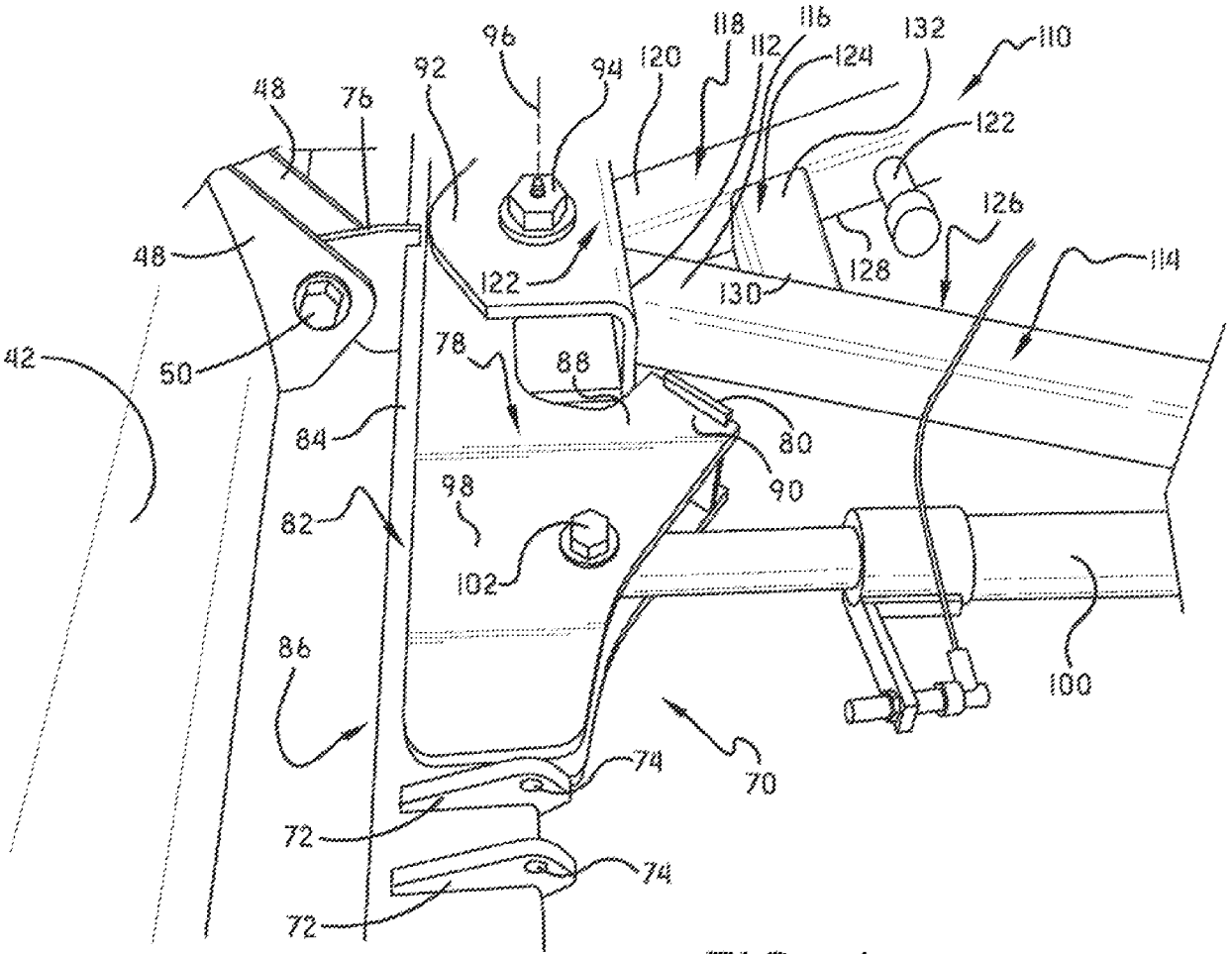
FIG. 4 is a top perspective view of a portion of the snowplow assembly.
Figure 5:
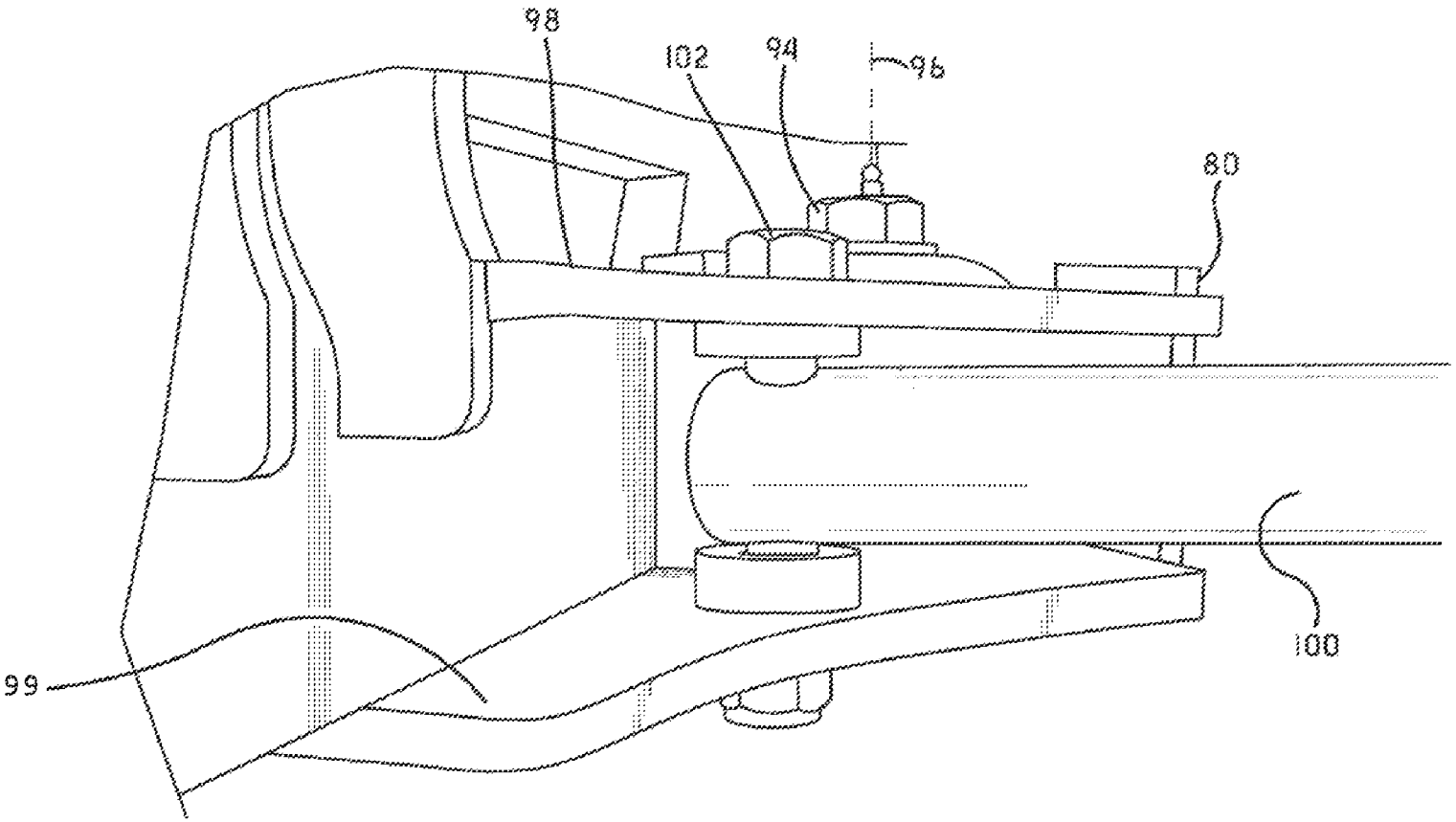
FIG. 5 is a side perspective view of the mount frame.

With reference now to FIGS. 3-5, the mount assembly 70 may include a flange 76 with an opening sized to receive the bolt or pin 50 for pivotally connecting the plow blade assembly 40 to the mount assembly 70. The mount assembly 70 may include a mount bar 82 extending along at least portion of the length of the plow blade assembly 40. The mount bar 82 may be formed of a hollow rectangular tube, an L-shaped or C-shaped angle member, or metal plates. The mount assembly 70 may include a stop plate 78 with a stop member 80 operatively attached. The stop plate 78 may be formed of two metal plates 98, 99, with one metal plate 98 attached to a top portion 84 of the mount bar 82, and the second metal plate 99 attached to a bottom portion 86 of the mount bar 82. The stop plate 78 may include a generally curved portion 88 extending away from the mount assembly 70 and extending towards a support assembly 110 with a stop member 80 fixedly attached to an end portion 90 of the curved portion 88 closest to the support assembly 110. The end portion 90 and stop member 80 are positioned for interacting with the support assembly 110, which will be described later in more detail. The stop plate 78 may have two generally curved portions 88 with one curved portion 88 located on opposite sides of a midpoint 92 of the mount assembly 70. In one embodiment, the two curved portions 88 generally extend in a direction towards each other. In another embodiment, the two curved portions 88 may be mirror images of each other around the midpoint 92. The mount assembly 70 may be pivotally connected to the support assembly 110 by a bolt or pin 94, or any other means chosen with sound judgment by one of ordinary skill in the art.

With continuing reference to FIGS. 3-5, and 10, an actuator 100 may be pivotally connected to the mount assembly 70 for pivoting the mount assembly 70 about a substantially vertical pivot axis 96 defined by the connecting bolt or pin 94. The actuator 100 may be a hydraulic or pneumatic cylinder, or any type chosen with sound judgment by one with ordinary skill in the art. In one embodiment, the actuator 100 is pivotally connected to the stop plate 78 by a bolt or pin 102. In another embodiment, one actuator 100 is pivotally connected to the stop plate 78 by a bolt or pin 102 on one side of the midpoint 92 and another actuator 100 is pivotally connected to the stop plate 78 by a bolt or pin 102 on the opposite side of the midpoint 92. A distance D1 from the bolt or pin 102 to the bolt or pin 94 is greater than a distance D2 from the mid-point of the stop member 80 to the bolt or pin 94. In one embodiment, D1 is between 5 and 20 inches and D2 is between 3 and 15 inches. In a more specific embodiment, D1 is between 8 and 10 inches and D2 is between 6 and 9 inches. A ratio of D1 to D2 (D1/D2) is between 1.1 and 2.0. In one embodiment, the ratio of D1 to D2 (D1/D2) is between 1.2 and 1.6.

With continuing reference to FIGS. 3-5, the support assembly 110 may have any shape chosen with sound judgment by one of ordinary skill in the art. In one embodiment, the support assembly 110 is an A-frame, as is well known in the art.

A first end 112 of the support assembly 110 may be pivotally connected to the mount assembly 70 by the bolt or pin 94. The second end (not shown) of the support assembly 110 is operatively connected to a vehicle (not shown). The support assembly 110 may be formed of rectangular tubing, L-shaped or C-shaped angle members, metal plates, or any other means chosen with sound judgment by one of ordinary skill in the art. The support assembly 110 may have a first member 114 with a first end 116 fixedly attached to a first end 120 of a second member 118. The first end 116 and first end 120 may form an apex portion 122 at the first end 112 of the support member 110. The second ends (not shown) of first member 114 and second member 118 are operatively attached to a vehicle (not shown). The second ends (not shown) of first member 114 and second member 118 may also be fixedly attached to a base member (not shown), as is well known in the art. The support member 110 may include a mount 122 for attaching a jack stand (not shown). The support member may include a cross member 124 fixedly attached to the first member 114 and the second member 118.

Figure 6:
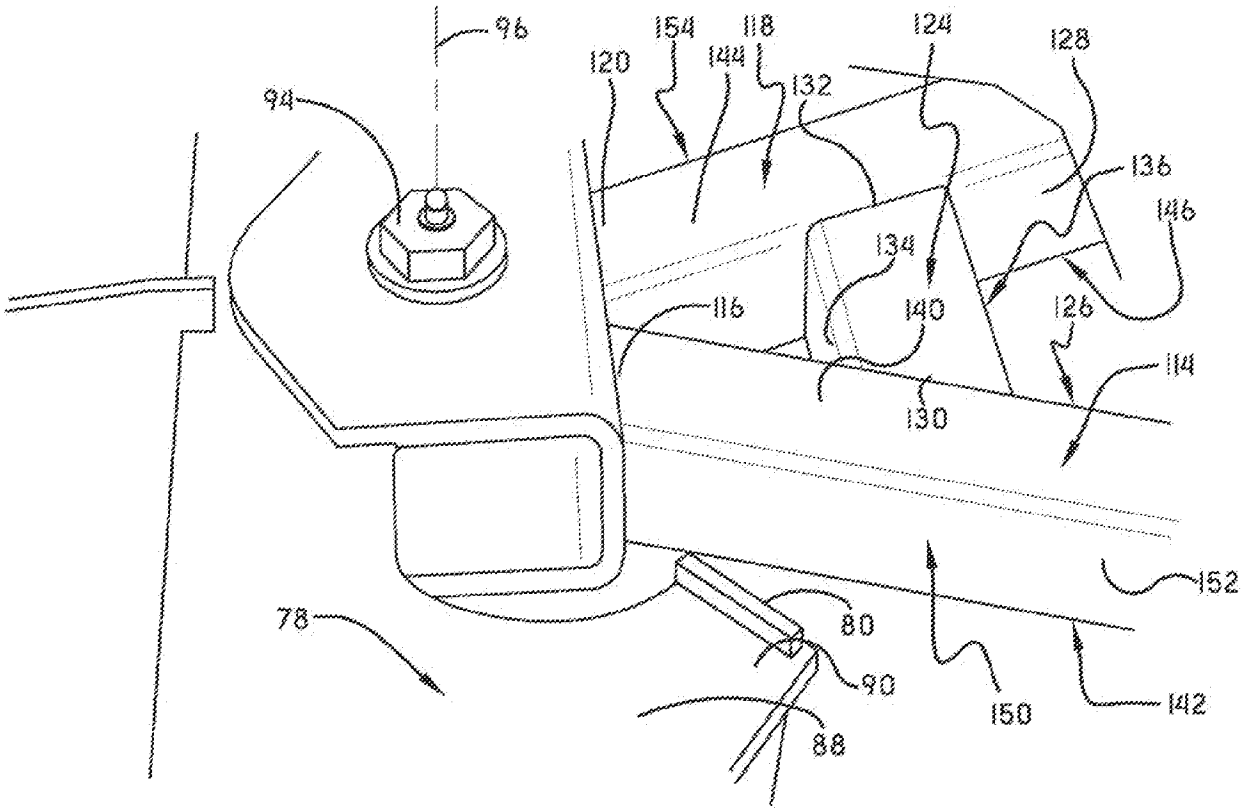
FIG. 6 is a top perspective view of a portion of the snowplow assembly.

With reference now to FIG. 6, in one embodiment, at least a portion of a first end 130 of the cross member 124 is fixedly attached to at least a portion of a first side 126 of first member 114 and at least a portion of a second end 132 of the cross member 124 is fixedly attached to at least a portion of a first side 128 of second member 118. In another embodiment, substantially the entire first end 130 of the cross member 124 is fixedly attached to the first side 126 of the first member 114 and substantially the entire second end 132 of the cross member 124 is fixedly attached to the first side 128 of the second member 118. The top portion 140 of the first member 114 may define a first horizontal plane. The bottom portion 142 of the first member 114 may define a second horizontal plane. In one embodiment, the entire cross member 124 is substantially between the first and second horizontal planes. The top portion 144 of the second member 118 may define a third horizontal plane. The bottom portion 146 of the second member 118 may define a fourth horizontal plane. In one embodiment, the entire cross member 124 is substantially between the third and fourth horizontal planes. The cross member 124 may have a forward side 134 and a rearward side 136. The distance from the apex portion 122 to the forward side 134 is less than the distance from the apex portion 122 to the rearward side 136. The forward side 134 may define a first vertical plane and the rearward side 136 may define a second vertical plane. The area between these two vertical planes defines a contact surface 150 on a second side 152 of the first member 114 and on a second side 154 of the second member 118.

Figure 7:
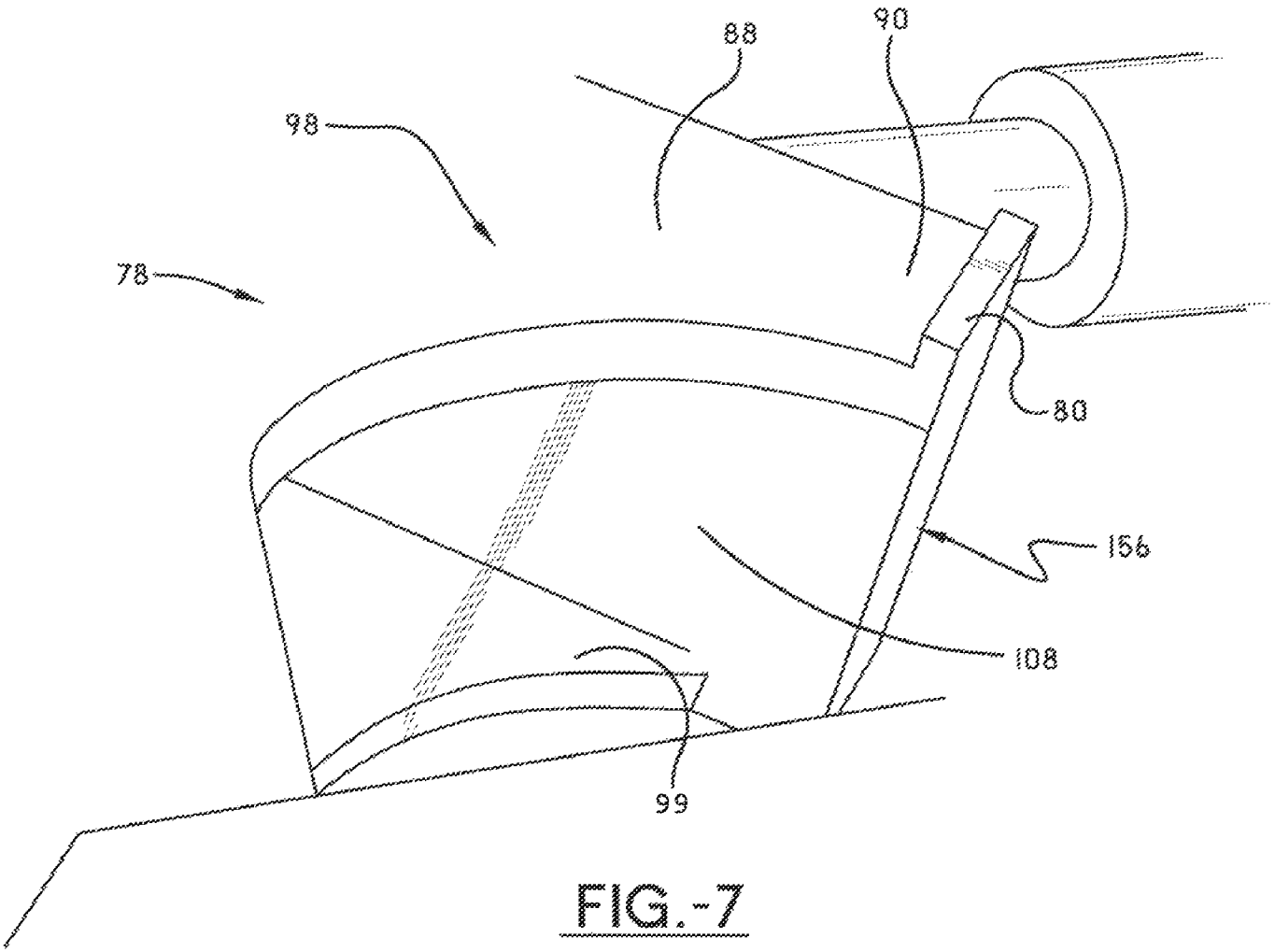
FIG. 7 is a perspective view of the stop member.

With reference now to FIG. 7, the stop plate 78 may include one or more vertical plates 108 fixedly attached to upper plate 98 and lower plate 99. This vertical plate 108 may provide support and rigidity to the curved portion 88 including the end portion 90. The vertical plate 108 may fixedly attach to the stop member 80 and may form a portion of a contact surface 156.

Figure 9:
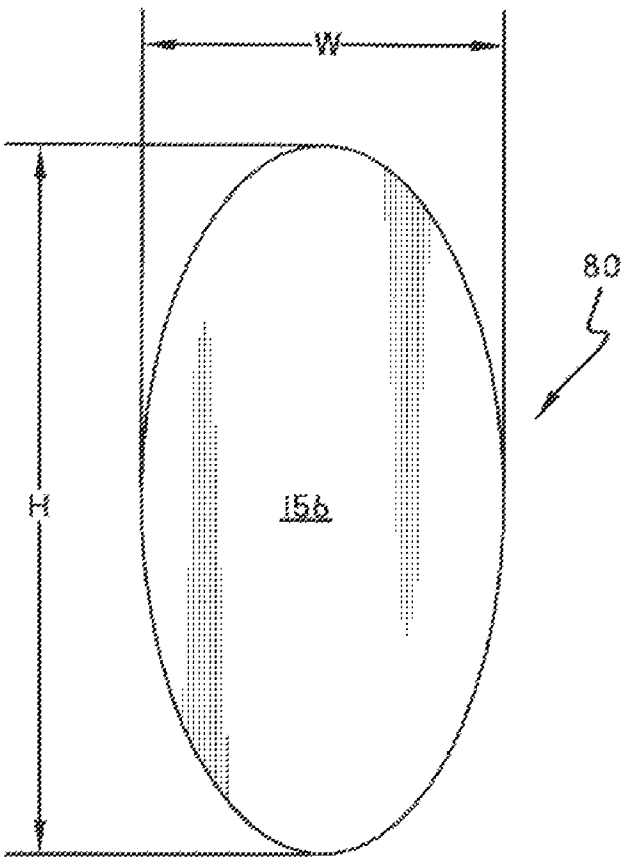
FIG. 9 is a front view of a stop member.
Figure 8:
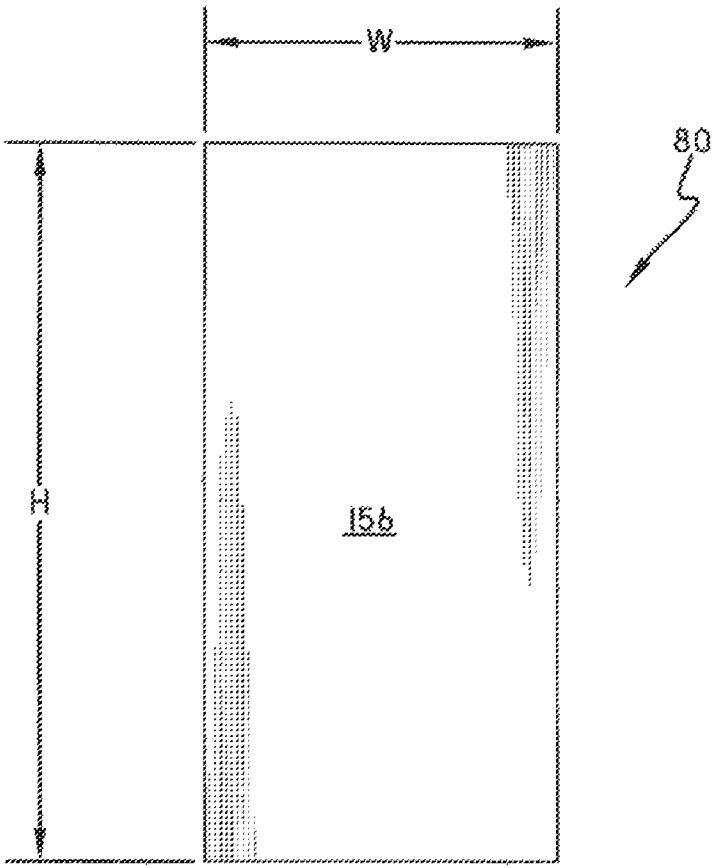
FIG. 8 is a front view of a stop member.
Figure 11:
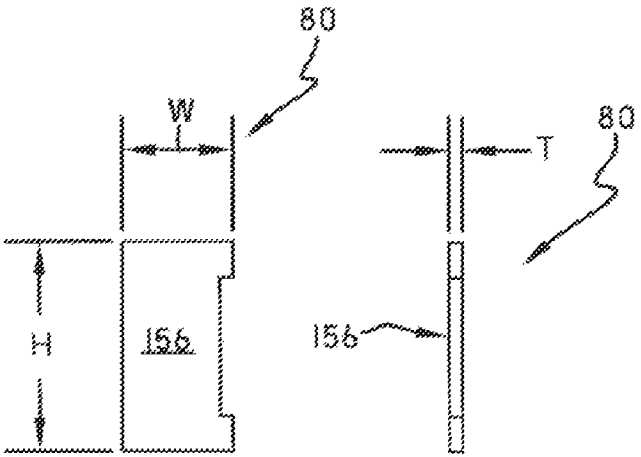
FIG. 11 is a front view and a side view of a stop member.

With reference now to FIGS. 8, 9, and 11, the contact surface 156 of the stop member 80 has a height H and width W. The contact surface 156 may have a generally rectangular shape, as shown in FIG. 8, according to one embodiment of this invention, or a generally oval shape, as shown in FIG. 9, according to another embodiment of this invention. In one embodiment, the height H is between 2 and 6 inches and the width W is between 1 and 4 inches. In a more specific embodiment, the height H is between 3 and 5 inches and the width W is between 1.5 and 2.5 inches. A ratio of the height H to the width W (H/W) is between 0.5 and 5.0. In one embodiment, the ratio of the height H to width W (H/W) is between 1.0 and 4.0. In a more specific embodiment, the ratio of the height H to width W (H/W) is between 1.5 and 2.5. The stop member 80 has a thickness T, as shown in FIG. 11. The thickness T can be between 0.125 and 0.75 inches. In one specific embodiment, the thickness T is between 0.20 and 0.30 inches.

Figure 10:
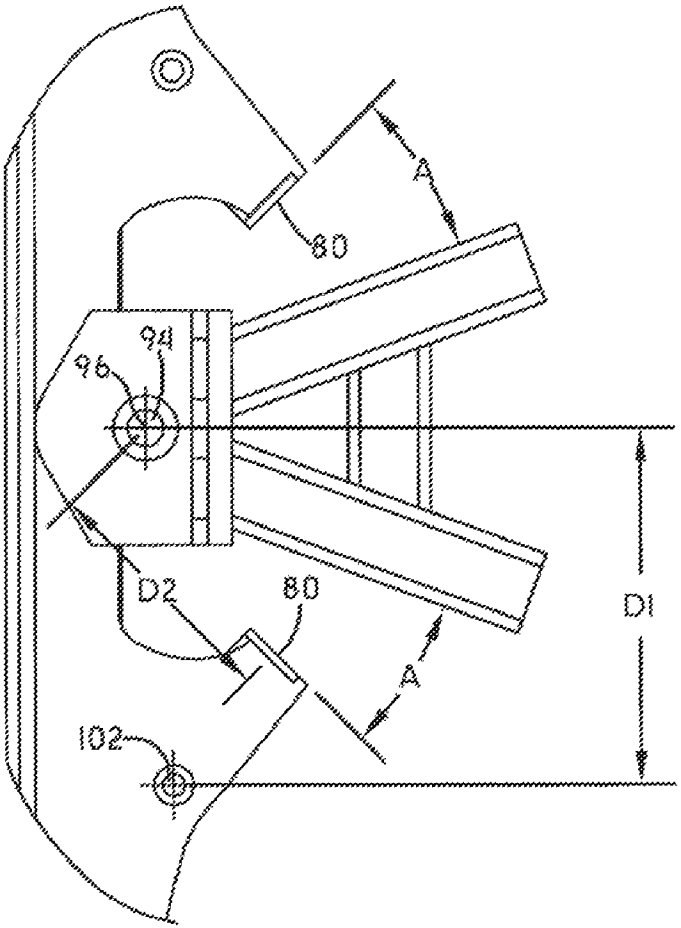
FIG. 10 is a top perspective view of a portion of the snowplow assembly.

With reference now to all the FIGURES, the operation will now be described. The actuator 100 can pivot the mount assembly 70 about the vertical pivot axis 96 in either the clockwise or counter-clockwise direction. When the mount assembly 70 is substantially perpendicular to the support assembly 110 as shown in FIGS. 3 and 10, the mount assembly is in a neutral position. When the mount frame 70 pivots through angle A degrees of rotation in either the clockwise or counter-clockwise direction from the neutral position, at least a portion of the contact surface 156 of the stop member 80 contacts at least a portion of the contact surface 150 on a second side 154 of the second member 118 or on a second side 152 of the first member 114. The angle A can be between 15 and 35 degrees. In one specific embodiment, angle A is between 20 and 30 degrees. Substantially the entire contact surface 156 of the stop member may contact at least a portion of the contact surface 150 on the second side 154 of the second member 118 or on the second side 152 of the first member 114. In another embodiment, at least a portion of the contact surface 156 of the stop member 80 contacts substantially the entire contact surface 150 on the second side 154 of the second member 118 or on the second side 152 of the first member 114. At least a portion of the contact surface 156 of the stop member 80 may extend above the top portion 140 of the first member 114 and at least a portion of the contact surface 156 of the stop member 80 may extend below the bottom portion 142 of the first member 114 when the contact surface 156 is in contact with the contact surface 150 on the second side 152 of the first member 114. At least a portion of the stop member 80 may extend above the top portion 144 of the second member 118 and at least a portion of the stop member 80 may extend below the bottom portion 146 of the second member 114 when the contact surface 156 of the stop member 80 is in contact with the contact surface 150 on the second side 154 of the second member 118.

Numerous embodiments have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

I claim:

1. A snowplow assembly comprising:

a support member having a first end operatively attached to a vehicle;

a mount member comprising:

a plow blade side operatively connected to a plow blade having a snow engaging surface for use in plowing snow;

a support side pivotally connected to the support member, wherein the mount member pivots about a substantially vertical axis with respect to the support member;

a first stop member for use in limiting the pivotal motion of the plow blade about the substantially vertical axis in a first direction, the first stop member comprising: (1) a first stop plate having a height and a width with a first ratio of height to width between 0.5 and 5, and (2) a C-shaped portion for positioning the first stop member to contact the first side of the support member, wherein the first stop plate operatively contacts a first side of the support member defining a first contact surface, and wherein the first contact surface extends substantially the entire length from a top portion to a bottom portion of the first side of the support member, and wherein the first stop plate extends above a top portion of the C-shaped portion;

a second stop member for limiting the pivotal motion of the plow blade about the substantially vertical axis in a second direction, the second stop member comprising: (1) a second stop plate having a height and a width with a first ratio of height to width between 0.5 and 5, and (2) a C-shaped portion for positioning the first stop member to contact the second side of the support member, wherein the second stop plate operatively contacts a second side of the support member defining a second contact surface, and wherein the second contact surface extends substantially the entire length from a top portion to a bottom portion of the second side of the support member, and wherein the second stop plate extends above a top portion of the C-shaped portion; and, a first actuator for use in pivoting the plow blade about the substantially vertical axis, wherein a first end of the first actuator is pivotally connected to the support member and a second end of the first actuator is pivotally connected to the mount member, and wherein a second ratio of a first distance between the second end of the actuator and the substantially vertical axis and a second distance between the stop member and the substantially vertical axis is between 1.1 and 2.0.

2. The snowplow assembly of claim 1 wherein the first stop member extends above the top portion of the first side of the support member and extends below the bottom portion of the first side of the support member when the first stop member is in contact with the first side of the support member.

3. The snowplow assembly of claim 2 wherein the second stop member extends above the top portion of the second side of the support member and extends below the bottom portion of the second side of the support member when the second stop member is in contact with the second side of the support member.

4. The snowplow assembly of claim 1 wherein the plow blade side is pivotally connected to the plow blade and the plow blade pivots about a substantially horizontal axis with respect to the mount member.

5. The snowplow assembly of claim 1 further comprising a second actuator for pivoting the plow blade about the substantially vertical axis, wherein a first end is pivotally connected to the support member and a second end is pivotally connected to the mount member, and wherein a third ratio of a first distance between the second end of the actuator and the substantially vertical axis and a second distance between the stop member and the substantially vertical axis is between 1.1 and 2.0.

6. The snowplow assembly of claim 1 wherein the first ratio is between 1.0 and 4.0.

7. The snowplow assembly of claim 1 wherein the second ratio is between 1.2 and 1.6.

8. The snowplow assembly of claim 5 wherein the third ratio is between 1.2 and 1.6.

9. The snowplow assembly of claim 1 wherein the first ratio is between 1.5 and 2.5.

10. A snowplow assembly comprising:

a support member comprising:

a first member having a first end and a second end, wherein the second end is operatively attached to a vehicle;

a second member having a first end and a second end, wherein the second end is operatively attached to a vehicle, and wherein the first end of the first member is fixedly attached to the first end of the second member forming an apex portion; and a cross member having: (1) a first end fixedly attached to the first member at a position spaced from the first end of the first member, wherein at least a portion of the cross member is between a first horizontal plane defined by a top portion of the first member and a second horizontal plane defined by a bottom portion of the first member, (2) a second end fixedly attached to the second member at a position spaced from the first end of the second member, wherein at least a portion of the cross member is between a third horizontal plane defined by a top portion of the second member and a fourth horizontal plane defined by a bottom portion of the second member, (3) a forward most surface; and, (4) a rearward most surface, wherein the forward most surface is closer to the apex portion than the rearward most surface, and wherein the forward most surface defines a first vertical plane and the rearward most surface defines a second vertical plane;

a mount member comprising:

a plow blade side operatively connected to a plow blade having a snow engaging surface for use in plowing snow;

a support side pivotally connected to the apex portion, wherein the mount member pivots about a substantially vertical axis with respect to the support member;

a first stop member for limiting the pivotal motion of the mount member about the substantially vertical axis in a first direction, wherein a portion of the first stop member operatively contacts a portion of the support member between the first vertical plane and the second vertical plane, and wherein the first stop member extends above a top portion of the mount member; and a second stop member for limiting the pivotal motion of the mount member about the substantially vertical axis in a second direction, wherein a portion of the second stop member operatively contacts a portion of the support member between the first vertical plane and the second vertical plane and wherein the second stop member extends above a top portion of the mount member; and a first actuator for pivoting the mount frame about the substantially vertical axis, wherein a first end of the first actuator is operatively connected to the snowplow assembly and a second end of the first actuator is operatively connected to the mount member.

11. The snowplow assembly of claim 10 wherein substantially the entire cross member is between the first and second horizontal planes and the third and fourth horizontal planes.

12. The snowplow assembly of claim 10 wherein the first end of the cross member is fixedly attached to a first side of the first member and the second end of the cross member is fixedly attached to a first side of the second member, wherein at least a portion of the first end of the cross member is fixedly attached between a top portion and a bottom portion of the first member, and wherein at least a portion of the second end of the cross member is fixedly attached between a top portion and a bottom portion of the second member.

13. The snowplow assembly of claim 12 wherein substantially the entire first end of the cross member is fixedly attached between the top portion and the bottom portion of the first member, and wherein substantially the entire second end of the cross member is fixedly attached between the top portion and the bottom portion of the second member.

14. The snowplow assembly of claim 12 wherein the first stop member operatively contacts a second side of the first member at a position between the first and second vertical planes defined by the cross member, and wherein the second stop member operatively contacts a second side of the second member at a position between the first and second vertical planes defined by the cross member.

15. The snowplow assembly of claim 12 wherein the first stop member extends above the top portion of the first member and extends below the bottom portion of the first member when the first stop member is in contact with a second side of the first member, and wherein the second stop member extends above the top portion of the second member and extends below the bottom portion of the second member when the second stop member is in contact with a second side of the second member.

16. The snowplow assembly of claim 10 wherein the plow blade side is pivotally connected to the plow blade and the plow blade pivots about a substantially horizontal axis with respect to the mount member.

17. The snowplow assembly of claim 10 wherein the first end of the first actuator is pivotally connected to the support member, and wherein the distance between the second end of the first actuator and the apex portion is greater than the distance between the first stop member and the apex portion.

18. The snowplow assembly of claim 17 further comprising a second actuator for pivoting the mount frame about the substantially vertical axis, wherein a first end is operatively connected to the snowplow assembly and a second end is pivotally connected to the mount member.

19. The snowplow assembly of claim 18 wherein the first end of the second actuator is pivotally connected to the support member, and wherein the distance between the second end of the second actuator and the apex portion is greater than the distance between the second stop member and the apex portion.

* * * * *